US011847862B2

(12) United States Patent
Marco et al.

(10) Patent No.: US 11,847,862 B2
(45) Date of Patent: Dec. 19, 2023

(54) SYSTEM FOR DIRECTING A TRANSPORTATION REQUEST TO A DRIVER WITH AN INACTIVE STATUS BASED ON EXCEPTION CRITERIA

(71) Applicant: Lyft, Inc., San Francisco, CA (US)

(72) Inventors: Talmon Marco, Tel Aviv (IL); Igor Magazinik, Ramat Gan (IL)

(73) Assignee: Lyft, Inc., San Francisco, CA (US)

( * ) Notice: Subject to any disclaimer, the term of this patent is extended or adjusted under 35 U.S.C. 154(b) by 1059 days.

(21) Appl. No.: 14/952,366

(22) Filed: Nov. 25, 2015

(65) Prior Publication Data

US 2017/0148229 A1 May 25, 2017

(51) Int. Cl.
*G06Q 50/30* (2012.01)
*G07B 15/02* (2011.01)

(52) U.S. Cl.
CPC ..... *G07B 15/02* (2013.01); *G06Q 50/30* (2013.01)

(58) Field of Classification Search
CPC ..... G07B 15/02; G06Q 50/30; G06Q 10/02
See application file for complete search history.

(56) References Cited

U.S. PATENT DOCUMENTS

2005/0075829 A1* 4/2005 Polimadei ..... G01C 22/02 702/165
2009/0216600 A1* 8/2009 Hill ..... G06Q 10/06 705/7.14
2010/0222027 A1* 9/2010 Scott ..... G06Q 30/02 455/412.2
2013/0158845 A1* 6/2013 Davis ..... G01C 21/3484 701/117
2015/0161554 A1* 6/2015 Sweeney ..... G06Q 50/30 705/7.15
2015/0206267 A1* 7/2015 Khanna ..... G06Q 50/30 705/5
2015/0356703 A1* 12/2015 Ellis ..... G06Q 50/30 705/7.17
2016/0027307 A1* 1/2016 Abhyanker ..... G08G 1/005 701/117
2016/0350812 A1* 12/2016 Priness ..... G06Q 30/0269
2017/0039890 A1* 2/2017 Truong ..... G07C 5/08

OTHER PUBLICATIONS

Ghoseiri et al., "Real-Time Rideshare Matching Problem," University of Maryland Department of Civil and Environmental Engineering, Jan. 2011, Retrieved from https://www.mautc.psu.edu/docs/umd-2009-05.pdf (Year: 2011).*

* cited by examiner

*Primary Examiner* — Rupangini Singh
*Assistant Examiner* — Bryan J Kirk
(74) *Attorney, Agent, or Firm* — Keller Preece PLLC

(57) ABSTRACT

In one embodiment an inactive status indication and one or more exception criteria are received from a computing device of a driver associated with a transportation service. A transportation request from a passenger associated with the transportation service is received. In response to a determination based on information included in the transportation request that the exception criteria is met, transportation request is directed to the driver.

20 Claims, 5 Drawing Sheets

SYSTEM FOR DIRECTING A TRANSPORTATION REQUEST TO A DRIVER WITH AN INACTIVE STATUS BASED ON EXCEPTION CRITERIA

TECHNICAL FIELD

This disclosure relates in general to the field of mobile applications and, more particularly, to a system for directing a transportation request to a driver with an inactive status based on exception criteria.

BACKGROUND

A transportation service may utilize a plurality of drivers that fulfill passenger requests for transportation. A transportation service may provide one or more mobile applications that facilitate the efficient pairing of passengers and drivers. The transportation service may receive a transportation request and select a driver to fulfill the request based on information associated with the transportation request and information associated with the driver.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DETAILED DESCRIPTION OF EXAMPLE EMBODIMENTS

Overview

In one embodiment an inactive status indication and one or more exception criteria are received from a computing device of a driver associated with a transportation service. A transportation request from a passenger associated with the transportation service is received. In response to a determination based on information included in the transportation request that the exception criteria is met, transportation request is directed to the driver.

Example Embodiments

Figure 1:
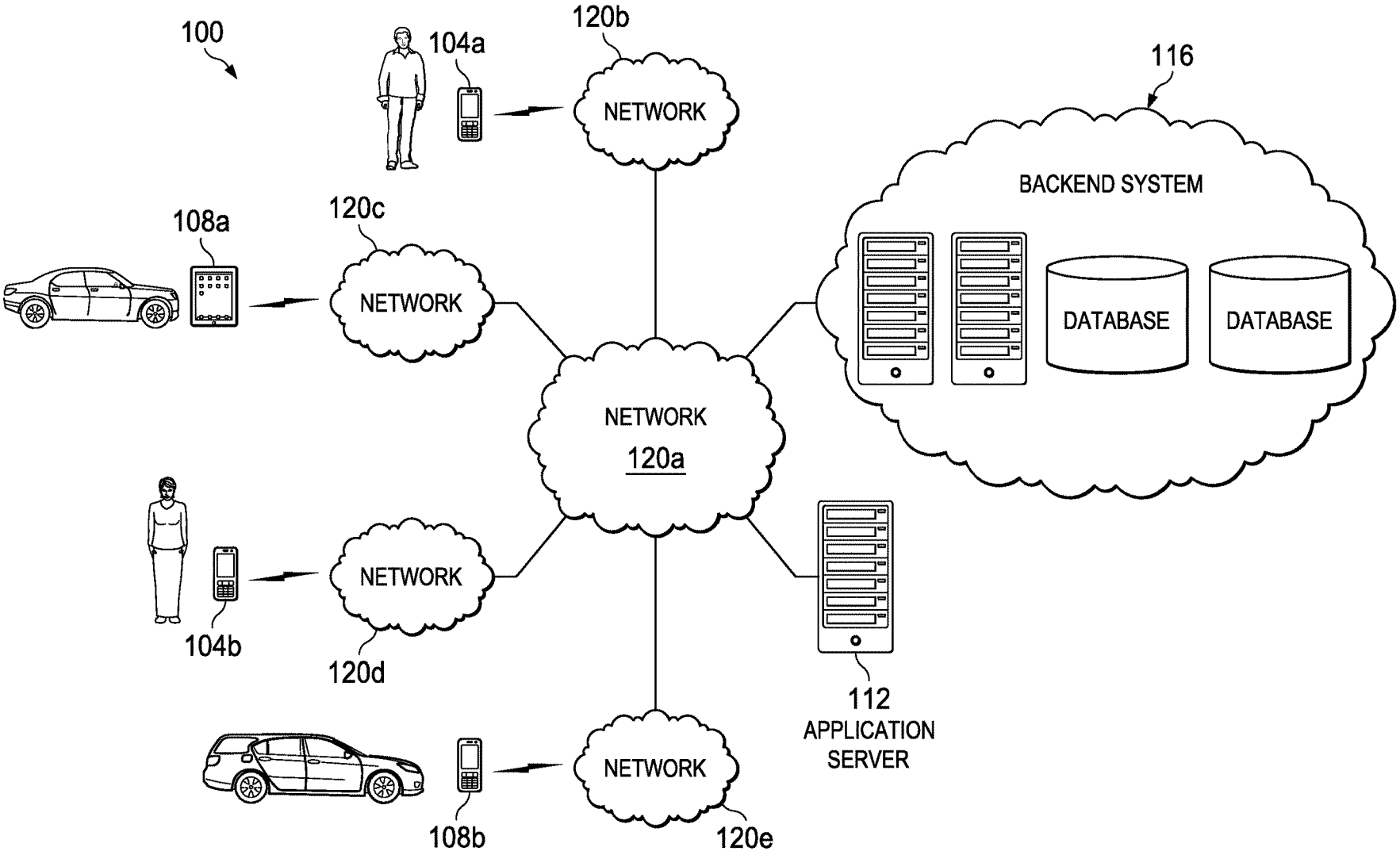
FIG. 1 illustrates a block diagram of a system for directing a transportation request to a driver with an inactive status based on exception criteria in accordance with certain embodiments.

FIG. 1 illustrates a block diagram of a system 100 for directing a transportation request to a driver with an inactive status based on exception criteria in accordance with certain embodiments. Although various embodiments may include any number of drivers, passengers, and associated devices, system 100 depicts two passengers having associated passenger mobile devices 104 and two drivers having associated driver mobile devices 108. The mobile devices are coupled through various networks 120 to an application server 112 and a backend system 116.

Various embodiments of the present disclosure may enhance the experience of drivers associated with a transportation service by allowing the driver to indicate a status of the driver to a backend system 116 associated with a transportation service. When the driver desires to take a break (e.g., to sleep, eat, drive home, or for another reason), he may indicate to the backend system 116 that his status is inactive. The driver may also indicate one or more exception criteria. The backend system 116 receives the indication of the driver's inactive status and the exception criteria and configures itself to only send transportation requests that satisfy the exception criteria to the driver while the driver remains inactive. Thus, the driver may avoid receiving transportation requests during his inactive state unless the request is particularly desirable according to criteria set by the driver. Various embodiments may provide technical advantages such as minimizing the workload on the backend system 116 and driver mobile devices 108 by reducing the sending of requests that are unlikely to be accepted by drivers and rapid determination of whether a driver should be interrupted with a particular transportation request.

Mobile devices 104 and 108 may include any electronic computing device operable to receive, transmit, process, and store any appropriate data. For example, mobile devices 104 and 108 may include laptop computers, tablet computers, smartphones, personal digital assistants, and other devices capable of connecting (e.g., wirelessly) to one or more networks 120. Mobile devices 104 and 108 may include a set of programs such as operating systems (e.g., Microsoft Windows, Linux, Android, Mac OSX, Apple iOS, UNIX, or similar operating system), applications, plug-ins, applets, virtual machines, machine images, drivers, executable files, and other software-based programs capable of being run, executed, or otherwise used by the respective devices. Each mobile device can include at least one graphical display and user interface allowing a user to view and interact with applications and other programs of the mobile device. In a particular embodiment, driver mobile devices may be a hardened device that is configured to only run a driver application using a specialized operating system (e.g., a modified version of Android). In one embodiment, a transportation service may issue or otherwise facilitate the provision of hardened devices to its drivers, but restrict the functionality of the devices to the driver application (i.e., the devices may be locked down so as not to allow the installation of additional applications).

In various embodiments, a driver mobile device 108 may be integrated within and/or communicate with a self-driven vehicle (e.g., a vehicle that has the capability of driving without physical steering guidance from a human being) and may influence the movement of the vehicle by providing route information (e.g., passenger pick-up and destination locations or driver destination locations) to the self-driven vehicle. Accordingly, as used herein "driver" may refer to a human being that may physically drive or otherwise control movement of a vehicle or the vehicle itself (e.g., in the case of a self-driven vehicle) or component thereof (e.g., mobile device application 108 or logic therein).

In particular embodiments, a passenger application runs on passenger mobile devices 104. The application may allow a user to enter various account information (e.g., in connection with a registration with the transportation service) to be utilized by a transportation service. For example, the account information may include a user name and password (or other login credentials), contact information of the user (e.g., phone number, home address), payment information (e.g., credit card numbers and associated information), or car preference information (e.g., what models or color of car the user prefers).

The application may allow a user to request a ride from the transportation service. In various embodiments, the application may establish a pick-up location automatically or based on user input (e.g., locations may include the current location of the mobile device 104 as determined by a global positioning system (GPS) of the mobile device or a different user-specified location). In certain embodiments, the user may specify a destination location as well. The locations may be specified in any suitable format, such as GPS coordinates, street address, establishment name (e.g., LaGuardia Airport, Central Park, etc.), or other suitable format. At any time (e.g., before the ride, during the ride, or after the ride is complete) the user may specify a method of payment to be used for the ride. The user may also specify whether the request is for immediate pick-up or for a specified time in the future. In various embodiments, the user may specify pick-up by a vehicle that has particular merchandise available for use by the user, such as a specified type of battery charger, bottle of water or other food or beverage, umbrella, or other suitable merchandise. The user may also specify criteria for the driver, such as a minimum performance rating, such that drivers having performance ratings below the minimum performance rating will not be considered during selection of the driver.

The user may use the application to order a ride based on the specified information. The request for the ride is generated based on the information and transmitted to backend system 116. Backend system 116 will facilitate the selection of a driver. In some embodiments, backend system 116 may select a driver based on any suitable factors, such as the information contained in the request from the passenger, the proximity of the driver to the passenger, or other suitable factors. In other embodiments, backend system 116 may select a plurality of drivers that could fulfill the ride request, send information associated with the drivers to the passenger, and allow the passenger to select the driver to be used via the application on the passenger mobile device 104. Any suitable information about the potential driver(s) may be sent to the mobile device 104 either before or after the selection of the driver by the passenger, such as a location of a driver, an estimated pick-up time, a type of car used by a driver, the merchandise available in the car, driver ratings or comments from other passengers about the driver, or other suitable information.

Once a driver has been selected and has accepted the request to provide a ride, the application may notify the user of the selected driver and provide real-time updates of the driver's location (e.g., with respect to the passenger's location) and estimated pick-up time. The application may also provide contact information for the driver and/or the ability to contact the driver through the application (e.g., via a phone call or text). Once the ride has begun, the application may display any suitable information, such as the current location of the mobile device 104 and the route to be taken. Upon completion of the ride, the application may provide the passenger the ability to rate the driver or provide comments about the driver.

In particular embodiments, a driver application runs on driver mobile devices 108. The application may allow a driver to enter various account information to be utilized by a transportation service. For example, the account information may include a user name and password (or other login credentials), contact information of the driver (e.g., phone number, home address), information used to collect payment (e.g., bank account information), vehicle information (e.g., what model or color of car the driver utilizes), merchandise offered by the driver, or other suitable information.

In various embodiments, the application may allow a driver to specify his availability to transport passengers for the transportation service. In some embodiments, the driver may select between multiple levels of availability. In one example, the driver may be "available," meaning that the driver is willing to receive and consider any transportation requests that the transportation service sends the driver; the driver may be "unavailable," meaning that the driver is not willing to receive any transportation requests (e.g., this state may be explicitly indicated by the driver inputting this state into his mobile device or by a deduction that the driver's device is not logged in to the transportation service through the driver application), or the driver may be "inactive," meaning that the driver only desires to receive particular requests meeting certain exception criteria.

The application may periodically transmit the current location of the mobile device 108 as determined by a GPS of the mobile device 108 to the backend system 116. When a driver is selected to provide a ride, backend system 116 may send a notification to the driver application. In some embodiments, the driver may have a limited amount of time to select whether the driver accepts the ride. In other embodiments, the application may be configured by the driver to automatically accept the ride or to automatically accept the ride if certain criteria are met (e.g., fare minimum, direction of travel, minimum passenger rating, etc.).

Once a pairing of the driver and the passenger is confirmed, the application may navigate the driver to the passenger. The application may also provide contact information for the passenger and/or the ability to contact the passenger through the application (e.g., via a phone call or text). The application may also navigate the driver to the passenger's destination once the ride begins. Upon completion of the ride, the application may provide the driver the ability to rate the passenger or provide comments about the passenger.

System 100 may include one or more application servers 112 coupled to the mobile devices through one or more networks 120. The passenger application and driver application may be supported with, downloaded from, served by, or otherwise provided through an application server 112 or other suitable means. In some instances, the applications can be downloaded from an application storefront onto a particular mobile device using storefronts such as Google Android Market, Apple App Store, Palm Software Store and App Catalog, RIM App World, etc., as well as other sources. In various embodiments, the passenger application and driver application may be installed on their respective devices in any suitable manner and at any suitable time. As one example, a passenger application may be installed on a mobile device as part of a suite of applications that are pre-installed prior to provision of the mobile device to a consumer. As another example, a driver application may be installed on a mobile device by a transportation service (or an entity that provisions mobile devices for the transportation service) prior to the issuance of the device to a driver that is employed or otherwise associated with the transportation service.

As described above, applications utilized by mobile devices 104 and 108 can make use of a backend system 116. Backend system 116 may comprise any suitable servers or other computing devices that facilitate the provision of a transportation service as described herein. For example, backend system 116 may receive a request from a passenger and facilitate the assignment of a driver to fulfill the request. Backend system 116 is described in more detail in connection with FIG. 3.

In general, "servers," and other "computing devices" may include electronic computing devices operable to receive, transmit, process, store, or manage data and information associated with system 100. As used in this document, the term "computing device," is intended to encompass any suitable processing device. For example, portions of system 100 may be implemented using computers other than servers, including server pools. Further, any, all, or some of the computing devices may be adapted to execute any operating system, including Linux, UNIX, Windows Server, etc., as well as virtual machines adapted to virtualize execution of a particular operating system, including customized and proprietary operating systems.

Further, servers and other computing devices of system 100 can each include one or more processors, computer-readable memory, and one or more interfaces, among other features and hardware. Servers can include any suitable software component or module, or computing device(s) capable of hosting and/or serving a software application or services (e.g., services of application server 112 or backend system 116), including distributed, enterprise, or cloud-based software applications, data, and services. For instance, servers can be configured to host, serve, or otherwise manage data sets, or applications interfacing, coordinating with, or dependent on or used by other services, including transportation service applications and software tools. In some instances, a server, system, subsystem, or computing device can be implemented as some combination of devices that can be hosted on a common computing system, server, server pool, or cloud computing environment and share computing resources, including shared memory, processors, and interfaces.

In various embodiments, backend system 116 or any components thereof may be deployed using a cloud service such as Amazon Web Services, Microsoft Azure, or Google Cloud Platform. For example, the functionality of the backend system 116 may be provided by virtual machine servers that are deployed for the purpose of providing such functionality or may be provided by a service that runs on an existing platform.

System 100 also includes various networks 120 used to communicate data between the mobile devices 104 and 108, the backend system 116, and the application server 112. The networks 120 described herein may be any suitable network or combination of one or more networks operating using one or more suitable networking protocols. A network may represent a series of points, nodes, or network elements and interconnected communication paths for receiving and transmitting packets of information. For example, a network may include one or more routers, switches, firewalls, security appliances, antivirus servers, or other useful network elements. A network may provide a communicative interface between sources and/or hosts, and may comprise any public or private network, such as a local area network (LAN), wireless local area network (WLAN), metropolitan area network (MAN), Intranet, Extranet, Internet, wide area network (WAN), virtual private network (VPN), cellular network (implementing GSM, CDMA, 3G, 4G, LTE, etc.), or any other appropriate architecture or system that facilitates communications in a network environment depending on the network topology. A network can comprise any number of hardware or software elements coupled to (and in communication with) each other through a communications medium. In some embodiments, a network may simply comprise a transmission medium such as a cable (e.g., an Ethernet cable), air, or other transmission medium.

Figure 2:
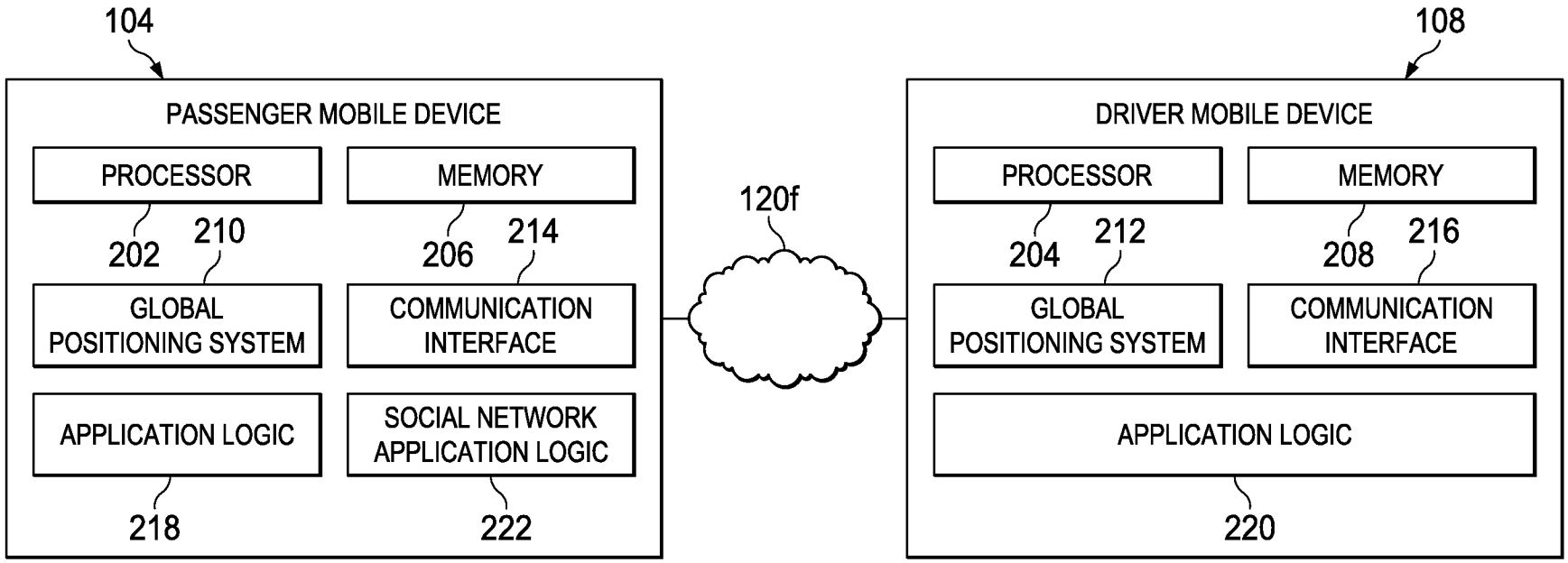
FIG. 2 illustrates a block diagram of a passenger mobile device and a driver mobile device of the system of FIG. 1 in accordance with certain embodiments.

FIG. 2 illustrates a block diagram of a passenger mobile device 104 and a driver mobile device 108 of the system of FIG. 1 in accordance with certain embodiments. In the embodiment shown, the devices may be communicatively coupled through network 120*f* which may include any suitable intermediary nodes, such as a backend system 116.

In the embodiment depicted, mobile devices 104 and 108 each include a computer system to facilitate performance of their respective operations. In particular embodiments, a computer system may include a processor, storage, and one or more communication interfaces, among other components. As an example, mobile devices 104 and 108 each include one or more processors 202 and 204, memory elements 206 and 208, and communication interfaces 214 and 216, among other hardware and software. These components may work together in order to provide functionality described herein.

Processors 202 and 204 may be a microprocessor, controller, or any other suitable computing device, resource, or combination of hardware, stored software and/or encoded logic operable to provide, either alone or in conjunction with other components of mobile devices 104 and 108, the functionality of these mobile devices. In particular embodiments, mobile devices 104 and 108 may utilize multiple processors to perform the functions described herein.

A processor can execute any type of instructions to achieve the operations detailed in this Specification. In one example, the processor could transform an element or an article (e.g., data) from one state or thing to another state or thing. In another example, the activities outlined herein may be implemented with fixed logic or programmable logic (e.g., software/computer instructions executed by the processor) and the elements identified herein could be some type of a programmable processor, programmable digital logic (e.g., a field programmable gate array (FPGA), an erasable programmable read only memory (EPROM), an electrically erasable programmable ROM (EEPROM)) or an ASIC that includes digital logic, software, code, electronic instructions, or any suitable combination thereof.

Memory 206 and 208 may comprise any form of non-volatile or volatile memory including, without limitation, random access memory (RAM), read-only memory (ROM), magnetic media (e.g., one or more disk or tape drives), optical media, solid state memory (e.g., flash memory), removable media, or any other suitable local or remote memory component or components. Memory 206 and 208 may store any suitable data or information utilized by mobile devices 104 and 108, including software embedded in a computer readable medium, and/or encoded logic incorporated in hardware or otherwise stored (e.g., firmware). Memory 206 and 208 may also store the results and/or intermediate results of the various calculations and determinations performed by processors 202 and 204.

Communication interfaces 214 and 216 may be used for the communication of signaling and/or data between mobile devices 104 and 108 and one or more networks (e.g., 120*f*) and/or network nodes (e.g., backend system 116 and application server 112) coupled to a network or other communication channel. For example, communication interfaces 214 and 216 may be used to send and receive network traffic such as data packets. Each communication interface 214 and 216 may send and receive data and/or signals according to a distinct standard such as an LTE, IEEE 802.11, IEEE 802.3, or other suitable standard. Communication interfaces 214 and 216 may include antennae and other hardware for transmitting and receiving radio signals to and from other devices in connection with a wireless communication session over one or more networks 120.

GPS units 210 and 212 may include any suitable hardware and/or software for detecting a location of their respective mobile devices 104 and 108. For example, a GPS unit may comprise a system that receives information from GPS satellites, wireless or cellular base stations, and/or other suitable source and calculates a location based on this information (or receives a calculated position from a remote source). In one embodiment, the GPS unit is embodied in a GPS chip.

Application logic 218 may include logic providing, at least in part, the functionality of the passenger application described herein. Similarly, application logic 220 may include logic providing, at least in part, the functionality of the driver application described herein. In a particular embodiment, the logic of devices 104 and 108 may include software that is executed by processor 202 and 204. However, "logic" as used herein, may include but not be limited to hardware, firmware, software and/or combinations of each to perform a function(s) or an action(s), and/or to cause a function or action from another logic, method, and/or system. In various embodiments, logic may include a software controlled microprocessor, discrete logic (e.g., an application specific integrated circuit (ASIC)), a programmed logic device (e.g., a field programmable gate array (FPGA)), a memory device containing instructions, combinations of logic devices, or the like. Logic may include one or more gates, combinations of gates, or other circuit components. Logic may also be fully embodied as software.

In various embodiments of the present disclosure, in addition to any combination of the features described above with respect to the passenger application, application logic 218 may provide additional features for the passenger application to enhance a passenger's experience.

In a particular embodiment, a user may supply login credentials for a social network system (e.g., FACEBOOK) or other social media system (e.g., TWITTER) to the transportation service through application logic 218. The transportation service (e.g., through backend server) may then access the user's account on the social network system or other social media system and access information associated with the user's account. As another example, passenger application logic 218 may access the user's social media account directly and integrate information from the account with other functionality of the passenger application logic.

Social network application logic 222 may provide a user interface to allow a passenger to interact with (e.g., enter and transmit information to and view information received from) a social network system. A social network system may store a record (i.e., a user profile) for each user of the system. The user profile may include any suitable information about the user, such as contact information, employment information, demographic information, personal interests, user-generated content, or other suitable information. The social network system may also store a record of the user's relationship with other users of the social network system. For example, such information may be stored as a social graph, wherein users (e.g., individuals, groups, business entities, organizations, etc.) may be represented as nodes in the graph and the nodes may be connected based on relationships between the users. A social network system may provide various services (e.g., photo sharing, wall posts, messaging, games, or advertisements) facilitating interaction between the users.

In various embodiments, the social network system may interact with passenger application logic 218 or backend server 302 to enhance the functionality of these components. As an example, background information associated with a passenger may be obtained by a backend server 302 and used to determine whether to route a request from the passenger to a particular driver.

In various embodiments, the social network system may provide any of the functionality listed above with respect to passenger application logic 218 in allowing a user to request a ride and may relay received requests for rides to backend server 302 along with any suitable identifying information about the user to facilitate pickup by a driver.

In various embodiments of the present disclosure, in addition to any combination of the features described above with respect to the driver application, driver application logic 220 may provide additional features for the driver application to enhance the functionality of the transportation service. For example, driver application logic 220 may allow the driver to enter an availability status, such as available, not available, or inactive, as described above. In various embodiments, driver application logic 220 may also allow the driver to enter information associated with an inactive status, such as a duration of the status or exception criteria and may transmit the status indication and any associated information to the backend system 116. The duration of the status may be indicated in any suitable manner. For example, the driver may specify a time (e.g., a finite time duration or an end time) indicating when the inactive status should end and the driver's status should return to available. As another example, if the driver is traveling to a destination location, the driver may indicate that the inactive status should end when the driver arrives at the destination location. In various embodiments, the driver may indicate his status as inactive at the time that he desires to enter the inactive status (e.g., by interacting with an interface of his mobile device to explicitly enter his status). In other embodiments, the driver may schedule the start and/or end of an inactive status (which may be a one-time scheduling or a periodic scheduling). For example, the driver may use driver application logic 220 to enter an inactive status from 5:00 to 6:00 each day in connection with the driver's commute home or from 12:00 to 1:00 in connection with the driver's lunch time. In various embodiments, driver application logic 220 may provide fields denoting "lunch" and "commute home" (or similar labels) for the driver to enter times associated with his daily commute and/or lunch time and may automatically trigger the inactive status at the appropriate time each day.

Driver application logic 220 may also provide an interface for allowing the driver to specify exception criteria associated with his inactive status. When a driver enters an inactive status, the backend system 116 will withhold sending transportation requests to the driver unless the specified exception criteria is met. The driver may enter any suitable criteria and may specify which conditions and how many conditions must be met before a transportation request is sent to the driver in any suitable manner. For example, the driver may specify a multiple different criteria and indicate that when any one of the criteria is met, requests may be sent to the driver. As another example, the driver may specify multiple different criteria and indicate that all the criteria must be met before requests are sent to the driver. As another example, the driver may specify a single criterion that must be met before requests are sent to the driver. As yet another example, the driver may specify multiple criteria and indicate that a certain number of criteria be met or that one or more particular combinations of criteria be met before transportation requests are sent to the driver.

Any suitable criteria may be specified by the driver. In one example, a criterion may be that a minimum cost (e.g., actual or expected cost) for the ride specified by the transportation request must be met or exceeded. In another example, a criterion may be that a minimum average cost (e.g., actual or expected cost per unit of time or per unit of distance) for the ride specified by the transportation request must be met or exceeded. In some embodiments this cost may be averaged over the expected time required for the ride itself or may also be averaged over additional travel time to and/or from the ride for the driver. In another example, a criterion may include a time length or a distance to be compared against an expected duration of the ride (which again may or may not also include travel to and/or from the pickup or destination location of the ride). For example, the driver may only want rides of shorter duration or may only want rides of longer duration. In another example, a criterion may specify a location. For example, the driver may specify that he only wants transportation requests that will take him closer to or within a specified distance of a specified location. As another example, the driver may specify that he only wants transportation requests specifying a pickup location that is within a specified distance of the driver's current location. In another example, a criterion may include a type of route. For example, the driver may specify a preference for city driving versus highway driving (or vice versa) and the criterion is only met when a majority (or other specified amount) of the drive will be in the city (or highway). In another example, a criterion may include one or more characteristics associated with the passenger. In various embodiments, the specified characteristics may be obtained from a social network profile of the passenger or the passenger account data 316. For example, the driver may specify that he would only like to provide rides to passengers from other locales (who may be likely to be tourists), to passengers from certain geographic areas, to passengers having a minimum specified passenger rating, or passengers with any other suitable criteria.

In various embodiments, when the one or more specified exception criteria is met and the driver receives a transportation request during a period in which the driver is in an inactive status, the driver may concurrently receive a notification as to which criteria were met. For example, a criterion as well as a value (e.g., cost, distance) of the transportation request corresponding to that criterion may be provided to the driver via driver application logic 220. In some embodiments, the driver may select to forego notification of the exception criterion (e.g., in favor of a standard view that is provided when a transportation request is received).

In various embodiments, the driver may be prompted to enter exception criteria when the driver uses driver application logic 220 to indicate that the driver's status is inactive. In some embodiments, driver application logic 220 (and/or backend server 302) may store previously entered exception criteria and associate that criteria with a current inactive status or allow the driver to update the stored criteria and associate the updated criteria with the current inactive status.

In various embodiments, instead of transferring the indication of the inactive status and associated exception criteria to the backend system 116, the driver application logic 220 may store this information locally (e.g., on mobile device 108). When a transportation request is directed to the mobile device 108, the driver application logic 220 may check the request to determine whether the exception criteria are met. If the criteria are not met, the driver application logic 220 may reject the request without requiring interaction from the driver. In at least some embodiments, the driver application logic 220 may forego presentation of the transportation request to the driver if the exception criteria are not met. If the exception criteria are met, the driver application logic 220 may present the transportation request to the driver and wait for the driver to indicate whether the driver would like to take the request (or in some embodiments may automatically accept the request on the driver's behalf) and may send the backend system 116 an indication that the ride has been accepted or rejected. Such embodiments, may ease the burden on the backend system by distributing the logic associated with the inactive status among the mobile devices of the various drivers.

Figure 3:
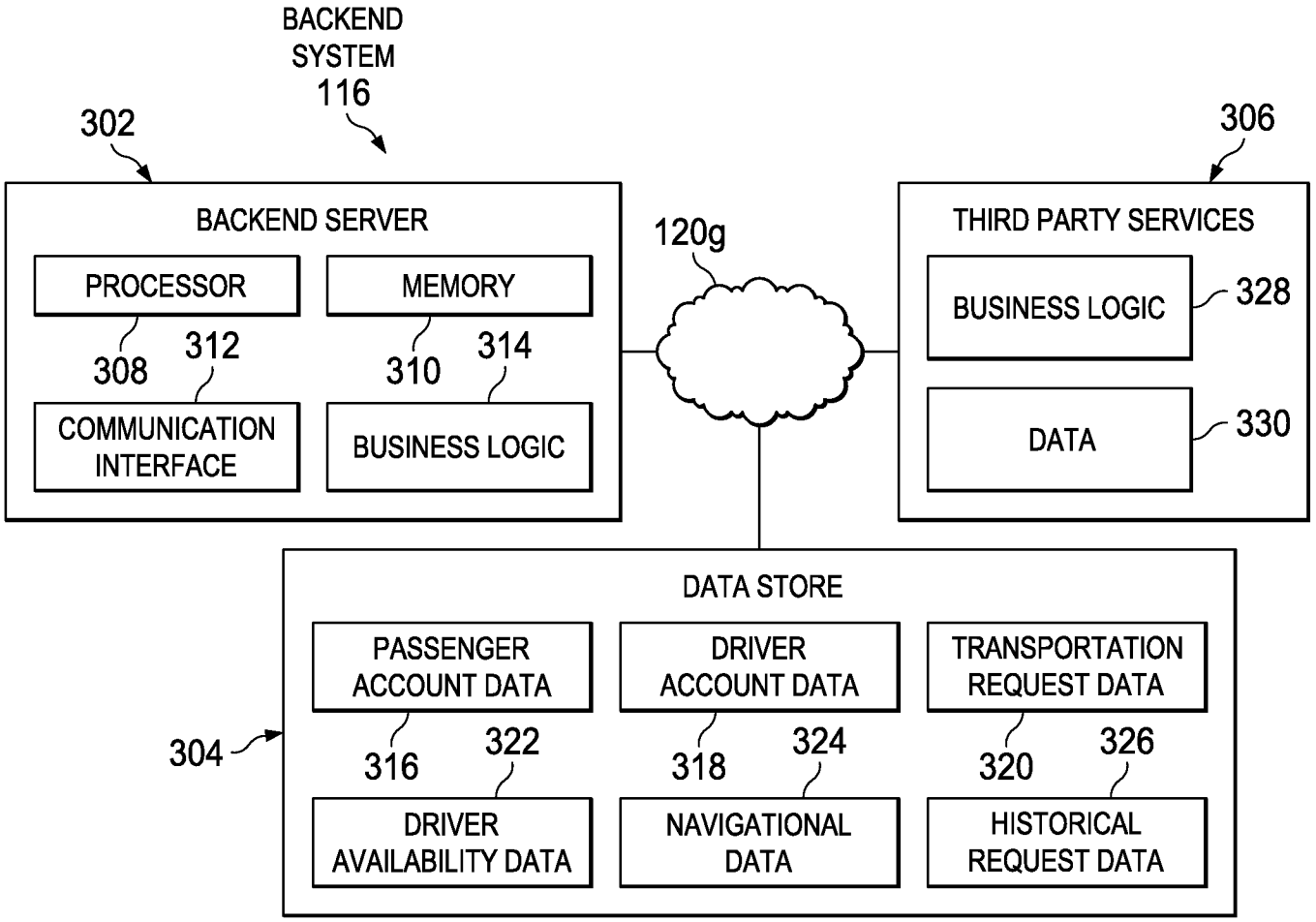
FIG. 3 illustrates a block diagram of a backend system of the system of FIG. 1 in accordance with certain embodiments.

FIG. 3 illustrates a block diagram of a backend system 116 of the system of FIG. 1 in accordance with certain embodiments. Although FIG. 3 depicts a particular implementation of the backend system 116, the backend system may include any suitable devices to facilitate the operation of the transportation service described herein. In the embodiment depicted, backend system includes backend server 302, data store 304, and third party services 306 coupled together by network 120*g*. In various embodiments, backend server 302, data store 304, and/or third party services 306 may each comprise one or more physical devices (e.g., servers or other computing devices) providing the functionality described herein. In some embodiments, one or more of backend server 302, data store 304, and third party services 306 (or portions thereof) are deployed using a cloud service and may comprise one or more virtual machines or containers.

In the embodiment depicted, backend server 302 includes a computer system to facilitate performance of its operations. As an example, backend server 302 includes one or more processors 308, memory elements 310, and communication interfaces 312, among other hardware and software. These components may work together in order to provide backend server functionality described herein. Processor 308 may have any suitable characteristics of the processors 202 and 204 described above. In particular embodiments, backend server 302 may utilize multiple processors to perform the functions described herein. In various embodiments, reference to a processor may refer to multiple discrete processors communicatively coupled together.

Similarly, memory 310 may have any suitable characteristics of memories 206 and 208 described above. Memory 310 may store any suitable data or information utilized by backend server 302, including software embedded in a computer readable medium, and/or encoded logic incorporated in hardware or otherwise stored (e.g., firmware). Memory 310 may also store the results and/or intermediate results of the various calculations and determinations performed by processor 308.

Communication interface 312 may also have any suitable characteristics of communication interfaces 214 and 216 described above. Communication interfaces 312 may be used for the communication of signaling and/or data between backend server 302 and one or more networks (e.g., networks 120) and/or network nodes (e.g., mobile devices 104 and 108, data store 304, third party services 306, and application server 112) coupled to a network or other communication channel.

Business logic 314 may have any suitable characteristics of application logic 218 and 220 described above. Business logic 314 may include logic providing, at least in part, the functionality of the backend server described herein. In a particular embodiment, business logic 314 may include software that is executed by processor 308. However, in other embodiments, business logic 314 may take other forms such as those described above with respect to application logic 218 and 220.

Backend server 302 may communicate with data store 304 to initiate storage and retrieval of data related to the transportation service. Data store 304, may store any suitable data associated with the transportation service in any suitable format(s). For example, data store 304 may include one or more database management systems (DBMS), such as SQL Server, Oracle, Sybase, IBM DB2, or NoSQL data bases (e.g., Redis and MongoDB).

In the embodiment depicted, data store 304 includes passenger account data 316, driver account data 318, transportation request data 320, driver availability data 322, navigational data 324, and historical request data 326. The various data may be updated at any suitable intervals.

Passenger account data 316 may include any suitable information associated with passenger accounts, such as contact information (e.g., real names and addresses), user names and passwords (or other authentication information), payment information (e.g., credit card or bank account numbers and associated information), passenger preferences (e.g., preferred type or color of car), ratings the passenger has given drivers, ratings the passenger has received from drivers, or other information associated with passenger profiles.

Driver account data 318 may include any suitable information associated with driver accounts, such as contact information (e.g., real names and addresses), user names and passwords (or other authentication information), payment collection information (e.g., bank account information), vehicle information (e.g., models and colors of cars the drivers utilize, maximum capacity of the cars of the drivers), merchandise offered by the drivers, whether the drivers are available to transport passengers, whether the drivers have opted for automatic acceptance of transportation requests (whereby the backend server 302 may assign a transportation request to the driver without waiting for the driver to indicate acceptance of a request), or other suitable information.

Transportation request data 320 may comprise pending requests (i.e., requests that have not yet been fulfilled) received from passengers. Each request may include any suitable information, such as any combination of one or more of an identification of the passenger making the request, the time the request was made, the current location of the passenger, the desired pick-up location, the desired pick-up time, the estimated time remaining until a driver can pick up the passenger, the actual pick-up time, the desired destination location of the passenger (which the passenger may or may not provide at the time the request is made), the expected arrival time at the destination location, the type of vehicle requested, estimated fare for the trip, current accumulated fare for the trip, estimated time and mileage remaining in the trip, other information specified by the user (e.g., requested merchandise, requested minimum rating of driver), whether a driver has been assigned to a request, and which driver has been assigned to a request.

Driver availability data 322 may comprise information associated with drivers that are available to transport passengers. In some embodiments, driver availability data 322 may also comprise information associated with drivers that are not available to transport passengers (e.g., because they are off-duty or currently transporting a passenger). An entry in the driver availability data 322 may include an identification of a driver and any suitable associated information, such as one or more of a current location of the driver, whether the driver is available to transport passengers, whether the driver is currently transporting a passenger, a destination location of a current trip of the driver, an estimate of how long it will be before the driver finishes his current trip, whether the driver has opted for automatic acceptance of transportation requests, or other suitable information.

Navigational data 324 may comprise information supporting navigation functions provided by the passenger applications and driver passenger applications. For example, navigational data 324 may comprise map data that may be sent to passenger mobile devices 104 and driver mobile devices 108 to allow the devices to display maps and associated indicators (e.g., location of passenger(s), location of driver(s), desired routes, etc.) In some embodiments, the navigational data may also comprise information indicative of the amount of time required to travel between various locations. In some embodiments, navigational data 324 may comprise historic and/or real time data about the flow of traffic in particular areas enabling backend server 302 to calculate an estimated time required to travel from one location to another.

Historical request data 326 may comprise information about completed requests. In some embodiments, historical request data 326 may also include information about canceled requests. The information for each request may include any combination of the information listed above with respect to requests stored in the transportation request data 320 as well as any combination of additional data such as the time at which the destination location was reached, the total time of the trip, the total fare, a rating given by the passenger to the driver or by the driver to the passenger for the trip, or other suitable information associated with the trip.

In various embodiments, backend server 302 may access third party services 306 through business logic 328 to access data 330. Third party services 306 may represent any suitable number of devices operated by any suitable number of third parties that are distinct from an entity that operates the backend system 116 and/or data store 304. For example, in some embodiments the navigational data may be obtained from a third party service 306 rather than data store 304, or additional third party navigational data such as map data or historical and/or current traffic flow information may be used to supplement navigational data 324. As another example, third party services 306 may authenticate users on behalf of the backend server 302 (e.g., through an account of the user with the third party). Business logic 328 may comprise any suitable logic operable to receive requests for data from backend system 116 and/or mobile devices 104 and 108 and provide responses to the requests.

Backend server 302 may be in communication with each passenger mobile device 104 and each driver mobile device 108 that is utilizing the transportation service at a particular time. Backend server may store information received from the mobile devices 104 and 108 in data store 304. Backend server 302 may also receive and respond to requests made by mobile devices 104 and 108 by processing information retrieved from data store 304.

When a passenger opens the passenger application, the backend server 302 may log the passenger in based on a comparison of authentication information provided by the passenger mobile device 104 with authentication information stored in passenger account data 316. The passenger may then request a ride. The request is received by the backend server 302 and stored in transportation request data 320. Backend server 302 may access driver availability data 322 to determine one or more drivers that would be suitable to fulfill the request from the passenger. In one embodiment, backend server 302 selects a particular driver (e.g., based on the driver's locality with respect to the passenger's pick-up location) and sends information associated with the request to the driver. The driver indicates whether he accepts or rejects the request via his mobile device 108. If the driver rejects the request, backend server 302 selects a different driver and the process is repeated until the backend server 302 receives an accepted request from a driver. In another embodiment, backend server 302 may select a plurality of drivers that may fulfill a passenger's request and allow the passenger to select one of the drivers. The backend server 302 may proceed to notify the driver of the request in a similar manner to that described above. In yet another embodiment, backend server 302 may select a plurality of drivers that may fulfill a passenger's request and notify each driver of the passenger's request. The backend server 302 may then allocate the request to one of the drivers based on any suitable criteria. For example, the driver who is the first to accept the request may be assigned to the request. As another example, if multiple drivers accept the request within a given timeframe, the request may be assigned to the most suitable driver (e.g., the driver that is closest to the pick-up location or a driver that has a car that meets preferred characteristics of the passenger's request).

Once the request has been accepted by a driver, the backend server 302 notifies the passenger that a driver has accepted his request and provides any suitable information associated with the driver (e.g., driver's current location, model and color of vehicle, estimated time of arrival, etc.) to the passenger.

The backend server 302 may provide navigation information to the driver mobile device 108 to direct the driver to the passenger's pickup location and subsequently to direct the driver to the passenger's destination location. The backend server 302 may also provide real-time updates associated with the trip to both the passenger and the driver.

Once the passenger's destination location has been reached, the backend server 302 may facilitate payment of the fare for the trip using payment information stored in passenger account data 316 and/or driver account data 318 (or information supplied by the passenger at the time of the transaction). The backend server 302 may also receive ratings associated with the trip for the passenger and driver and store these ratings in data store 304.

Backend server 302 may be operable to track the status of drivers associated with the transportation service and adjust the sending of transportation requests to the drivers based on their status. In some embodiments, backend server 302 may receive inactive status indications and one or more associated exception criteria from computing devices (e.g., 108) of the drivers. When an inactive status indication and associated exception criteria are received, backend server 302 may store this information in the data store 304 (e.g., in driver availability data 322).

The backend server 302 may use this information in any suitable manner in determining whether to send a particular transportation request to a particular driver. For example, in one embodiment, backend server 302 may exclude drivers with an inactive status from an initial search for a suitable driver for a particular transportation request and check the exception criteria of drivers with an inactive status only if no other suitable driver is found. As another example, drivers with an inactive status may be included in the initial search for one or more suitable drivers, and their exception criteria checked if they are selected as a suitable driver. As yet another example, the backend server could first determine whether exception criteria is met for a plurality of inactive drivers, and then include the inactive drivers with satisfied exception criteria in a search for a suitable driver. The exception criteria may be checked in any suitable manner by backend server 302, for example, by parsing information from the transportation request or other information associated with the passenger (e.g., passenger account data or a social network profile of the passenger) and comparing it against the criteria received from the drivers.

In any event, if the backend server 302 determines that a driver with inactive status has specified exception criteria that is met by the transportation request and that the driver is a suitable candidate to fulfill the request, the transportation request may be directed to the driver. If the backend server 302 determines that the exception criteria for a driver has not been met, then the backend server 302 removes the driver from consideration for fulfilling the transportation request and does not send the transportation request to the driver.

In various embodiments, backend server 302 may process a transportation request differently for drivers having an inactive status (as compared to drivers with an active status). For example, in one embodiment, the backend server 302 may offer a driver with an inactive status less time to respond as to whether the driver accepts the transportation request before offering the request to a different driver (because drivers who have indicated an inactive status may be less apt to monitor incoming requests). As another example, the backend server 302 may take one or more of the exception criteria into account in setting a price for the transportation request. For example, if the only suitable driver for a particular transportation request currently has an inactive status but has specified an exception criterion of a certain price or average price, the backend server 302 may advertise to the passenger a price that is higher than the price that would normally be charged (e.g., a baseline price) for a similar ride in order to facilitate the provision of the ride by the driver. For example, when the transportation uses dynamic pricing (i.e., sets prices based on demand), a driver may use the exception criteria to indicate that he will only take a ride if a certain price is met of if a price per distance unit or time unit is above a certain threshold, and the backend server may take this indication into account when setting the price for the ride.

Figure 4:
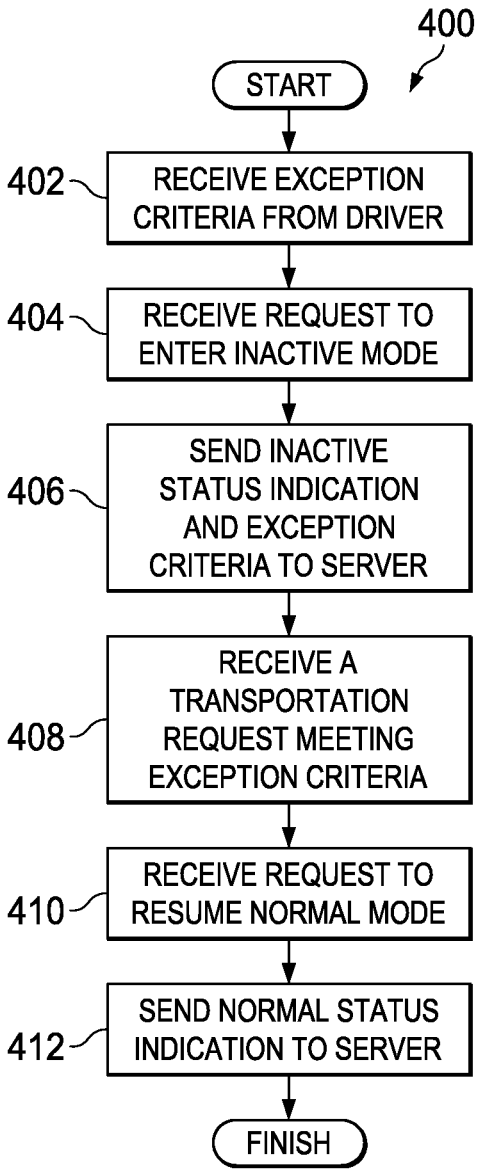
FIG. 4 illustrates a method for indicating an inactive status and receiving a transportation request based on exception criteria in accordance with certain embodiments.

FIG. 4 illustrates a method 400 for indicating an inactive status and receiving a transportation request based on exception criteria in accordance with certain embodiments. The steps of FIG. 4 may be performed, for example, by a mobile device 108.

At step 402, one or more exception criteria are received from a driver. At step 404, a request is received from the driver to enter inactive mode. In various embodiments, the exception criteria may be entered before or after the request to enter inactive mode is received. At step 406, an inactive status indication and the exception criteria are sent to a server, such as backend server 302.

At step 408, a transportation request that meets the exception criteria is received (e.g., from the server). The driver may decide whether to accept the transportation request. Additional transportation requests may be received while the driver is inactive, provided they meet the exception criteria. At step 410, a request to resume normal (e.g., "available") mode is received. As an example, the driver may enter the request at the time that the driver wishes the status to be changed. As another example, logic of the mobile device 108 may generate the request in response to a detection that an end time of a scheduled inactive status has been reached. At step 412, a normal status indication is sent to the server (e.g., backend server 302) to set the status of the driver back to available.

Some of the steps illustrated in FIG. 4 may be repeated, combined, modified or deleted where appropriate, and additional steps may also be included. Additionally, steps may be performed in any suitable order or concurrently without departing from the scope of particular embodiments.

Figure 5:
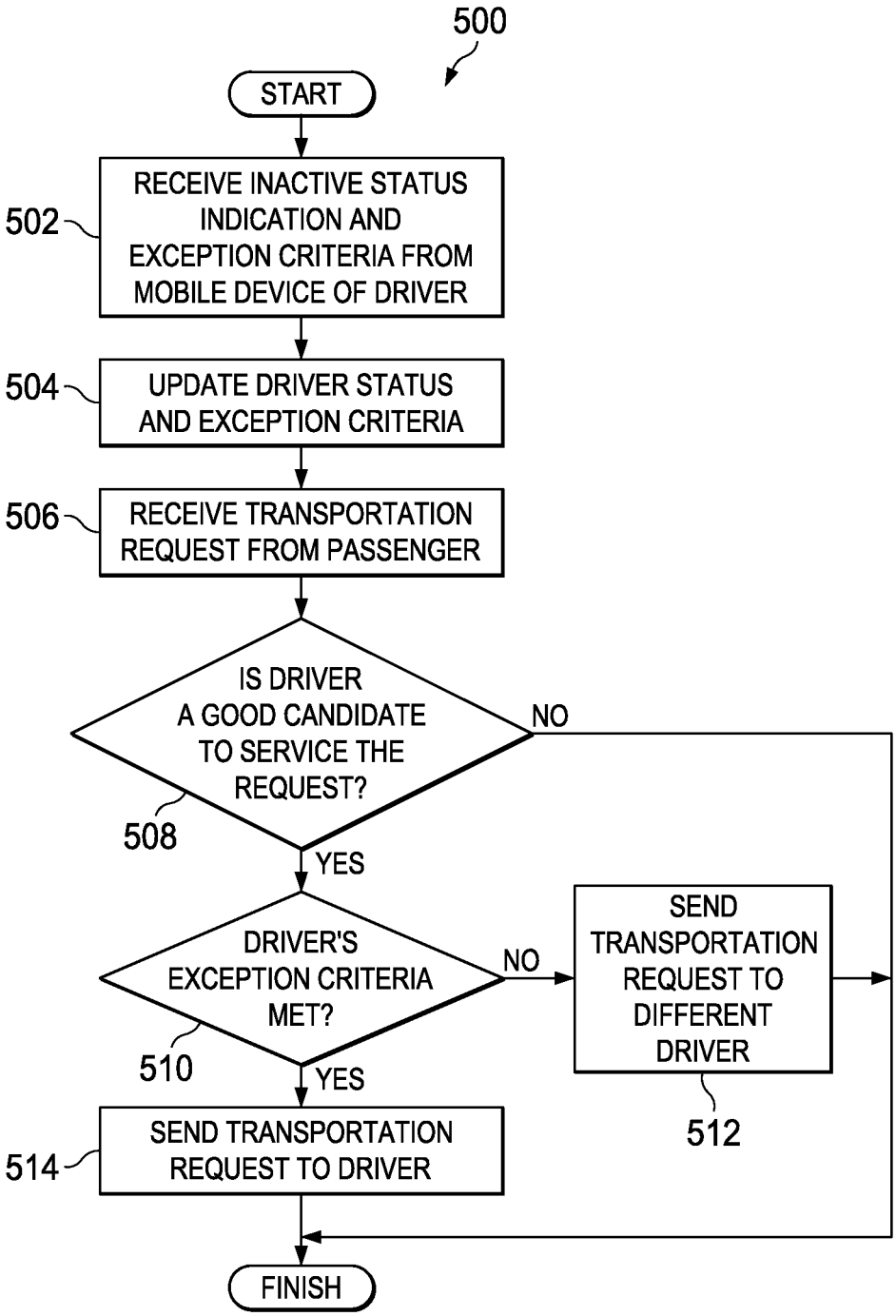
FIG. 5 illustrates a method for receiving an inactive status and sending a transportation request based on exception criteria in accordance with certain embodiments.

FIG. 5 illustrates a method 500 for receiving an inactive status and sending a transportation request based on exception criteria in accordance with certain embodiments. The steps of FIG. 4 may be performed, for example, by a backend server 302.

At step 502, an inactive status indication and exception criteria are received are received from a mobile device of a driver. At step 504, the driver's status and exception criteria are updated (e.g., within data store 304). At step 506, a transportation request is received from a passenger.

At step 508, it is determined whether the driver is a good candidate to service the request. If the driver is not a good candidate (e.g., a different driver is near the passenger and has a status of available), the method ends. If the driver is a good candidate, then it is determined whether the driver's exception criteria are met. If they are not met, the transportation request is sent to a different driver at step 512 and the method ends. If the exception criteria are met, the transportation request is sent to the driver.

Some of the steps illustrated in FIG. 5 may be repeated, combined, modified or deleted where appropriate, and additional steps may also be included. Additionally, steps may be performed in any suitable order or concurrently without departing from the scope of particular embodiments.

It is also important to note that the steps in FIGS. 4-5 illustrate only some of the possible scenarios that may be executed by, or within, the various components of the system described herein. Some of these steps may be deleted or removed where appropriate, or these steps may be modified or changed considerably without departing from the scope of the present disclosure. In addition, a number of these operations may have been described as being executed concurrently with, or in parallel to, one or more additional operations. However, the timing of these operations may be altered considerably. The preceding operational flows have been offered for purposes of example and discussion.

The functionality described herein may also be performed by any suitable component of the system. For example, certain functionality described herein as being performed by backend server 116, may, in various embodiments, be performed by any combination of one or more passenger mobile devices 104 or driver mobile devices 108 where appropriate. Similarly, certain functionality described herein as being performed by a passenger mobile device 104 or a driver mobile device 108 may, in various embodiments, be performed by backend server 116 where appropriate.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. A method comprising:

receiving, from a first set of driver computing devices in an active state, indications of the active state selected using a driver application and current locations of the first set of driver computing devices as determined by global positioning system (GPS) units of the first set of driver computing devices;

receiving, from a second set of driver computing devices in an inactive state, indications of the inactive state and exception criteria for selectively receiving transportation requests selected using the driver application;

receiving, from a passenger computing device, a transportation request for transporting a passenger associated with the passenger computing device;

based on a location of the passenger computing device and the current locations of the first set of driver computing devices, performing an initial search for the first set of driver computing devices in the active state to fulfill the transportation request and excluding the second set of driver computing devices in the inactive state from the initial search;

determining each driver computing device of the first set of driver computing devices in the active state cannot fulfill the transportation request;

receiving, from the second set of driver computing devices in the inactive state, indications of current locations of the second set of driver computing devices as determined by GPS units of the second set of driver computing devices;

based on comparisons of the location of the passenger computing device and the current locations of the second set of driver computing devices, performing a subsequent search for the second set of driver computing devices in the inactive state to fulfill the transportation request;

determining a driver computing device in the inactive state from the second set of driver computing devices can fulfill the transportation request by determining the transportation request satisfies particular exception criteria for the driver computing device;

transmitting the transportation request to the driver computing device in the inactive state in response to determining the transportation request satisfies the particular exception criteria; and receiving an indication of acceptance from the driver computing device in the inactive state to fulfill the transportation request.

2. The method of claim 1, wherein:

receiving the indications of the current locations of the first set of driver computing devices comprises receiving the indications of the current locations as determined by the GPS units of the first set of driver computing devices as part of periodic transmissions from the first set of driver computing devices; and receiving the indications of the current locations of the second set of driver computing devices comprises receiving the indications of the current locations as determined by the GPS units of the second set of driver computing devices as part of periodic transmissions from the second set of driver computing devices.

3. The method of claim 1, further comprising:

receiving, for the location of the passenger computing device, an indication of a current location of the passenger computing device as determined by a GPS unit of the passenger computing device; or receiving, for the location of the passenger computing device, an indication of a pickup location for the transportation request; and performing the subsequent search for the second set of driver computing devices in the inactive state based on distances between the current location of the passenger computing device or the pickup location for the transportation request and the current locations of the second set of driver computing devices.

4. The method of claim 1, wherein determining each driver computing device of the first set of driver computing devices in the active state cannot fulfill the transportation request comprises:

determining, in relation to the location of the passenger computing device, a current location of one or more driver computing devices of the first set of driver computing devices in the active state that are nearest the location of the passenger computing device; and determining that the current location of the one or more driver computing devices that are nearest the location of the passenger computing device of the first set of driver computing devices is unsuitable for picking up the passenger computing device based on a corresponding estimated time of arrival for pickup.

5. The method of claim 1, wherein determining the driver computing device in the inactive state from the second set of driver computing devices can fulfill the transportation request comprises:

parsing one or both of passenger account data for the passenger or transportation request data associated with the transportation request; and comparing the parsed data with the particular exception criteria for the driver computing device in the inactive state from the second set of driver computing devices.

6. The method of claim 1, wherein determining the driver computing device in the inactive state from the second set of driver computing devices can fulfill the transportation request comprises:

comparing a current location of the driver computing device with the location of the passenger computing device; and determining an estimated time of arrival of the driver computing device at a pickup location for the transportation request.

7. The method of claim 6, wherein comparing the current location of the driver computing device in the inactive state with the location of the passenger computing device occurs after determining the transportation request satisfies the exception criteria for the driver computing device.

8. The method of claim 1, wherein determining the transportation request satisfies the particular exception criteria for the driver computing device comprises determining that the location of the passenger computing device is within a threshold distance of a current location of the driver computing device.

9. An apparatus comprising:

a memory; and a processing device communicably coupled to the memory that causes the apparatus to:

receive, from a first set of driver computing devices in an active state, indications of the active state selected using a driver application and current locations of the first set of driver computing devices as determined by global positioning system (GPS) units of the first set of driver computing devices;

receive, from a second set of driver computing devices in an inactive state, indications of the inactive state and exception criteria for selectively receiving transportation requests selected using the driver application;

receive, from a passenger computing device, a transportation request for transporting a passenger associated with the passenger computing device;

based on a location of the passenger computing device and the current locations of the first set of driver computing devices, perform an initial search for the first set of driver computing devices in the active state to fulfill the transportation request and exclude the second set of driver computing devices in the inactive state from the initial search;

determine each driver computing device of the first set of driver computing devices in the active state cannot fulfill the transportation request;

receive, from the second set of driver computing devices in the inactive state, indications of current locations of the second set of driver computing devices as determined by GPS units of the second set of driver computing devices;

based on comparisons of the location of the passenger computing device and the current locations of the second set of driver computing devices, perform a subsequent search for the second set of driver computing devices in the inactive state to fulfill the transportation request;

determine a driver computing device in the inactive state from the second set of driver computing devices can fulfill the transportation request by determining the transportation request satisfies particular exception criteria for the driver computing device;

transmit the transportation request to the driver computing device in the inactive state in response to determining the transportation request satisfies the particular exception criteria; and receive an indication of acceptance from the driver computing device in the inactive state to fulfill the transportation request.

10. The apparatus of claim 9, wherein the processing device further causes the apparatus to:

receive the indications of the current locations of the first set of driver computing devices by receiving the indications of the current locations as determined by the GPS units of the first set of driver computing devices as part of periodic transmissions from the first set of driver computing devices; and receive the indications of the current locations of the second set of driver computing devices by receiving the indications of the current locations as determined by the GPS units of the second set of driver computing devices as part of periodic transmissions from the second set of driver computing devices.

11. The apparatus of claim 9, wherein the processing device further causes the apparatus to:

receive, for the location of the passenger computing device, an indication of a current location of the passenger computing device as determined by a GPS unit of the passenger computing device; or receive, for the location of the passenger computing device, an indication of a pickup location for the transportation request; and perform the subsequent search for the second set of driver computing devices in the inactive state based on distances between the current location of the passenger computing device or the pickup location for the transportation request and the current locations of the second set of driver computing devices.

12. The apparatus of claim 9, wherein the processing device further causes the apparatus to determine each driver computing device of the first set of driver computing devices in the active state cannot fulfill the transportation request by:

determining, in relation to the location of the passenger computing device, a current location of one or more driver computing devices of the first set of driver computing devices in the active state that are nearest the location of the passenger computing device; and determining that the current location of the one or more driver computing devices that are nearest the location of the passenger computing device of the first set of driver computing devices is unsuitable for picking up the passenger computing device based on a corresponding estimated time of arrival for pickup.

13. The apparatus of claim 9, wherein the processing device further causes the apparatus to determine the driver computing device in the inactive state from the second set of driver computing devices can fulfill the transportation request by:

parsing one or both of passenger account data for the passenger or transportation request data associated with the transportation request; and comparing the parsed data with the particular exception criteria for the driver computing device in the inactive state from the second set of driver computing devices.

14. At least one computer-readable non-transitory media storing one or more instructions that, when executed by a processing device, cause a computing device to:

receive, from a first set of driver computing devices in an active state, indications of the active state selected using a driver application and current locations of the first set of driver computing devices as determined by global positioning system (GPS) units of the first set of driver computing devices;

receive, from a second set of driver computing devices in an inactive state, indications of the inactive state and exception criteria for selectively receiving transportation requests selected using the driver application;

receive, from a passenger computing device, a transportation request for transporting a passenger associated with the passenger computing device;

based on a location of the passenger computing device and the current locations of the first set of driver computing devices, perform an initial search for the first set of driver computing devices in the active state to fulfill the transportation request and exclude the second set of driver computing devices in the inactive state from the initial search;

determine each driver computing device of the first set of driver computing devices in the active state cannot fulfill the transportation request;

receive, from the second set of driver computing devices in the inactive state, indications of current locations of the second set of driver computing devices as determined by GPS units of the second set of driver computing devices;

based on comparisons of the location of the passenger computing device and the current locations of the second set of driver computing devices, perform a subsequent search for the second set of driver computing devices in the inactive state to fulfill the transportation request;

determine a driver computing device in the inactive state from the second set of driver computing devices can fulfill the transportation request by determining the transportation request satisfies particular exception criteria for the driver computing device;

transmit the transportation request to the driver computing device in the inactive state in response to determining the transportation request satisfies the particular exception criteria; and receive an indication of acceptance from the driver computing device in the inactive state to fulfill the transportation request.

15. The at least one computer-readable non-transitory media of claim 14, wherein the particular exception criteria for the driver computing device in the inactive state corresponds to at least a route portion satisfying a route type in between a pickup location and a drop-off location, the route type including a city route portion or a highway route portion.

16. The at least one computer-readable non-transitory media of claim 14, further storing instructions that, when executed by the processing device, cause the computing device to:

receive the indications of the current locations of the first set of driver computing devices by receiving the indications of the current locations as determined by the GPS units of the first set of driver computing devices as part of periodic transmissions from the first set of driver computing devices; and receive the indications of the current locations of the second set of driver computing devices by receiving the indications of the current locations as determined by the GPS units of the second set of driver computing devices as part of periodic transmissions from the second set of driver computing devices.

17. The at least one computer-readable non-transitory media of claim 14, further storing instructions that, when executed by the processing device, cause the computing device to determine each driver computing device of the first set of driver computing devices in the active state cannot fulfill the transportation request by:

determining, in relation to the location of the passenger computing device, a current location of one or more driver computing devices of the first set of driver computing devices in the active state that are nearest the location of the passenger computing device; and determining that the current location of the one or more driver computing devices that are nearest the location of the passenger computing device of the first set of driver computing devices is unsuitable for picking up the passenger computing device based on a corresponding estimated time of arrival for pickup.

18. The at least one computer-readable non-transitory media of claim 14, further storing instructions that, when executed by the processing device, cause the computing device to determine the driver computing device in the inactive state from the second set of driver computing devices can fulfill the transportation request by:

parsing one or both of passenger account data for the passenger or transportation request data associated with the transportation request; and comparing the parsed data with the particular exception criteria for the driver computing device in the inactive state from the second set of driver computing devices.

19. The at least one computer-readable non-transitory media of claim 14, further storing instructions that, when executed by a processing device, cause the computing device to determine the driver computing device in the inactive state from the second set of driver computing devices can fulfill the transportation request by:

comparing a current location of the driver computing device with the location of the passenger computing device after determining the transportation request satisfies the exception criteria for the driver computing device in the inactive state; and determining an estimated time of arrival of the driver computing device at a pickup location for the transportation request.

20. The at least one computer-readable non-transitory media of claim 19, further storing instructions that, when executed by a processing device, cause the computing device to determine the transportation request satisfies the particular exception criteria for the driver computing device by determining that the location of the passenger computing device is within a threshold distance of the current location of the driver computing device.

* * * * *